United States Patent [19]

Berkowitz et al.

[11] 4,245,698

[45] Jan. 20, 1981

[54] SUPERALLOYS HAVING IMPROVED RESISTANCE TO HYDROGEN EMBRITTLEMENT AND METHODS OF PRODUCING AND USING THE SAME

[75] Inventors: Barry J. Berkowitz, Scotch Plains, N.J.; Russell D. Kane, Houston, Tex.

[73] Assignee: Exxon Research & Engineering Co., Florham Park, N.J.

[21] Appl. No.: 882,394

[22] Filed: Mar. 1, 1978

[51] Int. Cl.[3] ..... E21B 43/00; C22C 19/00; C22F 1/10

[52] U.S. Cl. ..... 166/244 C; 75/171; 148/11.5 N; 148/12.7 N; 148/32; 148/32.5

[58] Field of Search ..... 148/32, 32.5, 11.5 N, 148/12.7 N, 158, 162; 75/171; 166/244 C

[56] References Cited

U.S. PATENT DOCUMENTS

| | | | |
|---|---|---|---|
| 3,356,542 | 12/1967 | Smith | 148/32.5 |
| 3,767,385 | 10/1973 | Slaney | 148/32.5 |
| 4,080,201 | 3/1978 | Hodge et al. | 148/32 |
| 4,099,992 | 7/1978 | Pugliese et al. | 148/32 |
| 4,129,464 | 12/1978 | Matthews et al. | 148/32.5 |

OTHER PUBLICATIONS

Asphahani, Hydrogen Cracking of Nickel-Base Alloys, Jun. 6-11, 1977, Second International Congress on Hydrogen in Metals, Paris, France.

Kirchner et al., Materials Protection and Performance, 10 (1), pp. 11-15, Jan., 1971.

*Primary Examiner*—R. Dean

*Attorney, Agent, or Firm*—Albert P. Halluin

[57] ABSTRACT

Cold-worked superalloys having improved resistance to hydrogen embrittlement are disclosed. These new superalloys are nickel- or cobalt-chromium-molybdenum superalloys and possess improved resistance to hydrogen embrittlement rendering them useful in deep sour gas wells.

19 Claims, No Drawings

SUPERALLOYS HAVING IMPROVED RESISTANCE TO HYDROGEN EMBRITTLEMENT AND METHODS OF PRODUCING AND USING THE SAME

BACKGROUND OF THE INVENTION

1. Field of the Invention

This invention relates to nickel- or cobalt-chromium-molybdenum based superalloys which possess improved resistance to hydrogen embrittlement when cold-worked and aged.

2. Description of the Prior Art

Hydrogen embrittlement of steels and alloys has plagued a number of industries for many years. It has become especially a problem to oil and gas production as high concentrations of hydrogen sulfide are being frequently encountered. In search for additional production the oil and gas industry finds it necessary to drill deeper wells. Unfortunately, the current technology limits the strength levels of steels to approximately 560 MPa (80,000 psi) for sour hydrogen sulfide gas or oil wells. Above this strength level, catastrophic brittle failures in the presence of hydrogen sulfide can occur. Therefore, there is a need for substitutes for steels which will perform at high strength levels in these deleterious environments.

A major obstacle to successful drilling and completion of deep wells for oil and gas is hydrogen sulfide. When oil or gas is contaminated with hydrogen sulfide they are referred to as sour, and these sour environments cause a number of problems. A principal problem associated with these sour environments is their tendency to cause catastrophic, brittle failure of the metals used in drilling and completing the wells. This brittle failure can be a problem particularly when using the high strength steels needed for producing deep high pressure sour wells.

Catastrophic, brittle failure has been experienced with tubing, casing drill pipes, wire lines and related equipment. Sudden failure of such equipment can occur with little visible corrosion and no detectable plastic deformation. Moreover, brittle failures can occur in metals subjected to apparently safe loading and often after extended periods of satisfactory service. Such failures can result in loss or blowout of the well with disastrous consequences in terms of life and money.

Although the mechanism of such brittle failure is not fully understood, it is believed to be caused by entry of atomic hydrogen (H) into the metal. The hydrogen drastically reduces the ductility and causes the metal to crack. This phenomenon is commonly called hydrogen embrittlement. The mechanism of hydrogen embrittlement is more complex in the presence of hydrogen sulfide because of additional chemical reactions. In the presence of hydrogen sulfide, this mechanism is commonly called hydrogen sulfide embrittlement or sulfide stress cracking. The term hydrogen embrittlement, however, will be used herein in reference to brittle failure regardless of the hydrogen source.

Hydrogen sulfide is one source of the hydrogen and a common one. It may originate from water containing sulfur compounds, inflow of formation fluids, bacterial action on sulfates in drilling fluids, thermal degradation of drilling fluid additives and chemical reactions between sulfur compounds and metal. Hydrogen itself rather than hydrogen sulfide may be the cause of the brittle failure. Uncombined hydrogen can be generated from a number of sources including corrosion processes in the drilling fluids, bacterial action, and thermal degradation of organic additives.

Further discussion of hydrogen embrittlement problems in oil field production is described in the following references.

Greer, J. B., "Metal Thickens and Temperature Effects in Casing and Tubing Design for Deep, Sour Wells", paper SPE 3968, presented at SPE-AIME 47th Annual Fall Meeting, San Antonio, Tex., Oct. 11, 1972.

Watkins, M. and Greer, J. B., "Corrosion Testing of Highly Alloyed Materials for Deep Sour Gas Well Environments", paper SPE 5622, presented at SPE-AIME 50th Annual Fall Meeting, Dallas, Tex., Sept. 28–Oct. 1, 1975.

Greer, J. B., "Factors Affecting the Sulfide Stress Cracking Performance of High Strength Steels", *Materials Performance,* Vol. 14, pp. 11–22, January, 1975.

Kane, R. D. and Greer, J. B., "Sulfide Stress Cracking of High-Strength Steels in Laboratory and Oilfield Environments", paper SPE 6144, presented at SPE-AIME 51st Annual Fall Meeting, New Orleans, La., Oct. 3–6, 1976.

Kane, R. D., Watkins, M., Jacobs, D. F. and Hancock, G. L., "Factors Influencing the Embrittlement of Cold Worked High Alloy Materials in $H_2S$ Environments", *Corrosion,* 33 (9) 309–320 (September, 1977).

Several suggestions have been proposed to minimize equipment failure caused by hydrogen embrittlement. For example, inhibitor additives, protective coatings and metallurgical compositions have been proposed. Among the more promising metallurgical compositions proposed for use in deep sour wells are the highly alloyed metals such as high-strength super austenitic stainless alloys composed principally of nickel (and/or cobalt), chromium and molybdenum. One example of such superalloys is Hastelloy C-276* alloy (manufactured by Cabot Corporation) which is a nickel-based corrosion-resistant alloy with additions of 16% chromium, 16% molybdenum, 4% tungsten, 5% iron, and with the carbon and silicon contents maintained as low as practically possible. This alloy has been extensively described, e.g., British Pat. No. 1,160,835 and Canadian Pat. No. 859,062; R. B. Leonard, *Corrosion NACE,* 25 (5) 222 (1969); R. B. Leonard, *Chemical Engineering Progress,* 65 (7) 84 (1969); R. W. Kirchner and W. L. Silence, *Materials Protection and Performance,* 10 (1) 11, (1971); and R. B. Leonard, *Metal Progress,* pp. 87–88, March, 1971.

*A registered trademark of Cabot Corporation.

Another example of such a super alloy is Hastelloy C-4* alloy (also manufactured by Cabot Corporation) which is a nickel-based corrosion-resistant alloy with additions of 16% chromium, 15% molybdenum, less than 2% iron, a maximum of 0.5% tungsten, less than 0.5% aluminum, less than 1% cobalt, less than 0.5% manganese, up to 0.5% titanium, less than 0.01% carbon and less than 0.03% silicon. This alloy has been described, e.g. British Pat. No. 1,454,814; M. A. Streicher, *Corrosion NACE,* 32 (3) 79 (1976); F. G. Hodge and R. W. Kirchner, *Corrosion NACE,* 32 (8) 332 (1976); T. S. Lee and F. G. Hodge, *Materials Performance,* pp. 29–36 (September 1976) and B. E. Paige, *Materials Performance,* pp. 22–28 (December, 1976).

*A registered trademark of Cabot Corporation.

As reported by M. Watkins and J. B. Greer, *J. Pet. Tech.,* 28 698 (1976) these superalloys not only have good corrosion resistance but appear to resist embrittlement in hydrogen producing environments, even at high strength levels under the limited test conditions (i.e., unaged and uncoupled to steel).

Other proposed methods to reduce embrittlement problems in conventional steel components include contacting the metal equipment with hydrogen sulfide at temperatures above 150° F., avoiding use of pipe that has been cold-straightened or cold-worked, using biocides to control sulfate reducing organisms, maintaining a high pH (9–10.5) within the well and using thicker wall pipe to reduce high stresses. Although the oil and steel industries have made significant efforts to resolve the hydrogen embrittlement problems of steels, most of the proposed methods are essentially ineffective to totally protect metal equipment from brittle failure.

It was recently discovered that four cold-worked nickel and cobalt-base superalloys (Hastelloy C-276*, Hastelloy C-4*, Inconel 625 and MP35N*) can be susceptible to hydrogen embrittlement in corrosive aqueous environments when coupled to steel and when stressed in the transverse direction and that the embrittlement susceptibility is substantially affected by heat treatment (Kane, R. D., Watkins, M., Jacobs, D. F. and Hancock, G. L., *Corrosion,* 33 (9), 309–320 (September, 1977)). Their susceptibility to hydrogen embrittlement is increased by aging treatments conducted within the temperature range of 200° C. and 500° C. It was recently discovered, however, that in the case of cold-worked multi-phase type alloys, such as in the case of MP35N***, which are heat-treated at a temperature ranging from about 1300° F. (704.4° C.) to about 1600° F. (871.1° C.) for a time interval within the range from about ¼ to 100 hours, a substantial resistance to hydrogen embrittlement is obtained. A more complete description of this innovation is described in U.S. Ser. No. 767,609, filed Feb. 10, 1977, abandoned entitled "Alloys Having Improved Resistance to Hydrogen Embrittlement", the disclosure of which is incorporated herein by reference.

*A registered trademark of Cabot Corporation.
**A registered trademark of Huntington Alloys, Inc.
***A registered trademark of Standard Pressed Steel Co.

R. M. Latanision and H. Opperhauser, Jr., *Met. Trans.,* 5, 483 (1974) recently indicated that tramp impurity segregation in materials correlates to increased susceptibility to hydrogen embrittlement.

As oil and gas wells are drilled deeper and as higher concentrations of hydrogen sulfide are encountered at higher pressures, there is a substantially unfilled need for high-strength superalloy material which has improved resistance to hydrogen embrittlement.

DISCOVERY OF THE INVENTION

It has now been discovered that the hydrogen embrittlement behavior of nickel- and cobalt-based superalloys such as Hastelloy C-276* alloy is related to the grain boundary concentration of phosphorus. This conclusion is supported by the following observations:

(1) Both the grain boundary phosphorus concentration and the hydrogen embrittlement susceptibility increase with aging severity; and (2) Low phosphorus heats of Hastelloy C-276* alloy perform better than similarly processed commercial heats in hydrogen producing environments.

*A registered trademark of Cabot Corporation.

The discovery, that phosphorus promotes embrittlement in a nickel-base superalloy, is not entirely surprising since R. M. Latanision and H. Opperhauser, Jr., *Met. Trans.* 5, 483 (1974) reported that metalloids other than phosphorus, namely, tin and antimony promote embrittlement in pure annealed nickel. It is, however, surprising that the nickel or cobalt-based superalloys, which are not very susceptible to hydrogen embrittlement in the unaged conditions, embrittle after relatively low temperature aging (200° C. for 260 hours). This phenomenon is believed to be explanable in terms of the defect density that is present in these heavily cold-worked materials. Cold-working will produce many vacancies as well as a very high dislocation density. Lattice diffusion is enhanced by the excess vacancy concentration (as reported by B. Russel and P. Vela, *Phil. Mag.,* 8, 677 (1963)) and, more importantly, pipe diffusion will occur along the many dislocations (as reported by Paul G. Shewman, *Diffusion In Solids,* Chapter 6, McGraw-Hill, New York, 1963). Therefore, relatively insevere aging treatments can result in sufficient diffusion of phosphorus to populate the grain boundaries, and thus, an increase in hydrogen embrittlement susceptibility.

It has been found that in a commercial heat of a nickel-based superalloy, i.e., Hastelloy C-276* alloy, manufactured by Cabot Corporation, phosphorus, which is typically present as a tramp element in the range of 0.01 to 0.025% by weight is responsible for intergranular failures when subjected to C-ring tests in hydrogen sulfide solutions. Although the bulk concentration of phosphorus is low, it has been found that during commercial heat treatments of these commercial nickel-based superalloys (such as Hastelloy C-276* alloy) phosphorus segregates to the grain boundaries resulting in intercrystalline weakness. By use of Auger spectroscopy, it has been found that as much as 3% of the grain boundary surface is populated by phosphorus in a superalloy whose bulk chemical analysis is 0.025% phosphorus (two orders of magnitude enhancement).

*A registered trademark of Cabot Corporation.

There are at least two ways to improve the hydrogen cracking resistance in the nickel- and cobalt-based superalloys:

(1) Limit or control the introduction of phosphorus in the production of the alloy. If the bulk concentration of the phosphorus in the alloy is controlled so as to be less than 0.003 wt. %, significant improvements in the hydrogen sulfide cracking resistance will result.

(2) Precipitate the phosphorus by the addition of another element(s) which reacts with phosphorus to form a harmless compound and thus prevent the phosphorus from segregating to the grain boundaries.

In addition, hydrogen embrittlement can be abated by similar control of the other metalloid impurities in the case of the nickel- or cobalt-based superalloys and many other alloys including carbon steels, alloy steels and superalloys.

SUMMARY OF THE INVENTION

The present invention pertains to cold-worked superalloys which possess improved hydrogen sulfide cracking resistance. The superalloys of the present invention are characterized as being cold-worked and age strengthened nickel-chromium-molybdenum or cobalt-chromium-molybdenum superalloys having a tensile strength ranging from 150 to about 250 ksi and a resistance to hydrogen embrittlement such that when a steel anode is galvanically coupled to a test specimen (e.g., a C-ring) of said superalloy and said test specimen is exposed to an aqueous test solution saturated with hydrogen sulfide containing 5% NaCl and 0.5% acetic acid, by weight, at room temperature and at atmospheric pressure, the test specimen resists hydrogen embrittlement or cracking for more than 25 days when it is stressed to 100% of the transverse 0.2% offset yield strength.

As another embodiment of the present invention there is provided a process for producing a superalloy characterized as having a high tensile strength and an improved resistance to hydrogen embrittlement when subjected to an oxygen-free hydrogen sulfide saturated aqueous solution containing 5% NaCl and 0.5% acetic acid, by weight, at room temperature and at atmospheric pressure, which comprises treating an alloy of the following chemical composition in weight percent:

| | |
|---|---|
| Phosphorus | <0.003 |
| Chromium | 12–25 |
| Molybdenum | 10–20 |
| Iron | 0–10 |
| Cobalt | 0–50 |
| Aluminum | 0–0.5 |
| Columbium | 0–4 |
| Titanium, Zirconium or Hafnium | 0–3 |
| Tungsten | 0–7 |
| Manganese | 0–1 |
| Vanadium or Tantalum | 0–0.75 |
| Carbon | 0–0.02 |
| Silicon | 0–0.08 |
| Nickel and Incidental Impurities | Balance |

by the steps:

(a) cold-working said alloy within the range from about 15% to about 90% reduction in area, and (b) age strengthening cold-worked alloy at a temperature ranging from about 300° F. to about 1100° F.

The superalloys of the present invention are preferably comprised of a single phase matrix of a superalloy selected from the group consisting of nickel-based superalloys and cobalt-based alloys wherein the phosphorus content in said superalloys is maintained and controlled at a level of less than 0.003 wt. %. The superalloys of the present invention are preferably nickel- or cobalt-chromium-molybdenum based superalloys.

Another preferred aspect of the invention comprises using a cold-worked nickel- or cobalt-chromium-molybdenum based superalloy wherein the phosphorus content in said superalloy is maintained and controlled at a level of less than 0.003 wt. %, preferably less than 0.002 wt. %, in a hydrogen or hydrogen sulfide environment, e.g., deep sour gas or oil wells. The cold-worked superalloys of the present invention preferably contain less than 1 At. %, and preferably less than 0.5 At. %, of phosphorus in their grain boundaries.

DESCRIPTION OF THE PREFERRED EMBODIMENTS

In accordance with the practice of the present invention, there is provided a cold-worked nickel-based alloy having a composition within the broad range as set forth in Table I hereafter.

TABLE I

| Element | Range, Wt. % |
|---|---|
| Phosphorus | <0.003 |
| Chromium | 12–25 |
| Molybdenum | 10–20 |
| Iron | 0–10 |
| Cobalt | 0–50 |
| Aluminum | 0–0.5 |

TABLE I-continued

| Element | Range, Wt. % |
|---|---|
| Columbium | 0–4 |
| Titanium, Zirconium or Hafnium | 0–3 |
| Tungsten | 0–7 |
| Manganese | 0–1 |
| Vanadium or Tantalum | 0–0.75 |
| Carbon | 0–0.02 |
| Silicon | 0–0.08 |
| Nickel and Incidental Impurities | Balance |

The nickel content of the superalloys of the invention should be at least 30 wt. % of the alloy.

Molybdenum is present in the alloys described above to provide resistance to pitting corrosion and to provide solid-solution strengthening. Alloys having molybdenum compositions above about 20 wt. % tend to have unacceptably low ductility.

Chromium is also present in the alloys to provide corrosion resistance and solid-solution strengthening. However, the chromium should not exceed 25 wt. % because the ductility decreases substantially at compositions above this, particularly when the alloy is cold-worked.

Iron may be present in amounts up to 10%, but should not exceed this concentration because higher concentrations tend to reduce the corrosion resistance of the alloy.

Cobalt may be added to the alloy to enhance solid-solution and work-strengthening, however, the composition should not exceed about 50 wt. %, and preferably does not exceed about 2.5 wt. %.

The aluminum and titanium compositions should be kept low in order to prevent gamma prime ($\gamma'$) precipitation hardening of the alloy. As will be discussed later herein, the alloys of the present invention are not strengthened by precipitation hardening.

Various incidental elements may be added to the alloys of the present invention to improve forging properties, strengthening, corrosion resistance or for other benefits.

The alloys of the class described above, particularly with reference to those included in Table I and in Tables II and III hereinafter, may be work-hardened by any form of mechanical deformation processing such as forging, rolling, drawing, spinning or bending. The terms "cold-work" and "work-strengthen" are used synonymously herein to mean mechanical deformation carried out on a metal below its recrystallization temperature to produce permanent strain in the metal. This recrystallization temperature is generally considered to be the minimum temperature in which a totally new grain structure will appear in the cold-worked alloy within a specified time. The degree of cold-working of the alloys of this invention can generally vary within a range from about 15% to about 90% reduction in area, preferably 25% to about 75% reduction in area, and more preferably 35% to 65% reduction in area.

A more preferred cold-worked superalloy of the present invention falls within the ranges set forth in Table II.

TABLE II

| Element | Range, Wt. % |
|---|---|
| Phosphorus | <0.002 |
| Chromium | 14–17 |
| Molybdenum | 14–16 |
| Iron | 0–7 |
| Cobalt | 0–2.5 |

TABLE II-continued

| Element | Range, Wt. % |
|---|---|
| Aluminum | 0–0.5 |
| Columbium | 0–4 |
| Titanium, Zirconium or Hafnium | 0–0.75 |
| Tungsten | 0–4 |
| Manganese | 0–1 |
| Vanadium or Tantalum | 0–0.4 |
| Carbon | 0–0.01 |
| Silicon | 0–0.03 |
| Nickel and Incidental Impurities | Balance |

A further preferred cold-worked composition of the present invention is shown in Table III.

TABLE III

| Element | Range, Wt. % |
|---|---|
| Phosphorus | <0.001 |
| Chromium | 14–16 |
| Molybdenum | 15–17 |
| Iron | 4–7 |
| Cobalt | 0–2.5 |
| Aluminum | 0–0.2 |
| Titanium | 0–0.5 |
| Tungsten | 3–4.5 |
| Manganese | 0–1 |
| Vanadium | 0–0.4 |
| Carbon | 0–0.01 |
| Silicon | 0–0.03 |
| Nickel | 52–56 |
| Incidental Impurities | Balance |

A convenient procedure for preparing the above-described superalloys is as follows.

Predetermined proportions of the alloy components of the present invention are melted in a vacuum induction furnace at a temperature sufficient to melt the components. The components should be of such a purity so as not to introduce phosphorus wherein the level in the final alloy exceeds 0.003 wt. %, unless an agent is added to sequester or precipitate the phosphorus, thereby preventing the phosphorus from segregating to the grain boundaries upon cold-working. The alloy can also be melted in an electro slag remelt furnace or in an open-air induction furnace. The alloy melt is then cast in an ingot mold. Subsequently, the alloy is cold-worked at a temperature below the alloy's recrystallization temperature. Normally, the recrystallization temperature is not a fixed temperature, but a range depending on such variables as the initial grain size, composition, amount of previous cold-work, temperature cycle and time.

In general, hardening and strengthening of metals or alloys depends on the chemical composition and then on the mechanical and thermal processing of the metal. Mechanical and thermal processes may include casting, sintering, hot working, cold-working and various heat treatments. Such processing steps influence mechanical properties by their effect on grain size, inclusions, voids, size and distribution of phases and lattice imperfections.

The alloys of the present invention are strenghthened and hardened primarily by solid-solution strengthening and cold-working. Solid-solution strengthening of alloys is generally imparted by elements such as tungsten, molybdenum, tantalum, columbium and chromium. These strengtheners are primarily found in the matrix phase of the processed alloy. As discussed previously, the alloys of the present invention are solid-solution strengthened primarily by molybdenum and chromium.

Cold-working the solid-solution strengthened alloys further increases the alloys' hardness and yield strength. However, unless the cold-worked alloys are either treated to remove the phosphorus or the introduction phosphorus is controlled such that it does not exceed the herein prescribed amounts, they tend to have a high susceptibility to embrittlement in hydrogen environments.

Although nickel-based alloys are commonly hardened and strengthened by carbide precipitation and gamma prime ($\gamma'$) phase precipitation, the low phosphorus alloys of the present invention are not precipitation hardened by $\gamma'$ or carbide phases. Carbide precipitation is generally promoted through the addition of carbide forming elements such as titanium, columbium and hafnium to the alloy. Precipitation of the $\gamma'$ phase is effected through the addition of elements needed to form this phase, principally aluminum and titanium, although limited quantities of other elements may be found in this phase. The $\gamma'$ phase is usually represented by the formula $Ni_3(Al,Ti)$. The alloys of the present invention have a low aluminum and titanium composition to prevent formation of the gamma prime precipitates.

Generally, solid-solution strengthened nickel-chromium-molybdenum alloys may be further strengthened by aging at temperatures ranging from 800° F. (426.6° C.) to 1200° F. (648.8° C.). It has been suggested that this strengthening is the result of the formation of ordered phase such as $Ni_2(CrMo)$. It is of interest that Matthews, "Thermal Stability of Solid Solution Strengthened High Performance Alloys", *Structure and Properties of Materials,* 3, pp. 215–226, indicated that Hastelloy C-4* alloy has maximum strength when aged at about 1000° F. (537.7° C.), and aging the alloy at temperatures above 1100° F. (593.3° C.) causes its strength to decrease. The alloys of the present invention may be suitably aged at temperatures ranging from about 300° F. to about 1100° F., preferably at temperatures ranging from about 750° F. to about 1000° F. The most preferred aging temperature for the superalloys of the present invention is about 900° F.

*A registered trademark of Cabot Corporation.

The present invention is more particularly described in the following example which is intended as illustrative only since numerous modifications and variations therein will be apparent to those skilled in the art.

EXAMPLE

The following series of tests are offered to demonstrate the surprising and unexpected results of the cold-worked super alloys in accordance with the practice of the present invention compared against commercial heats of comparable superalloys. The alloys examined in these tests had the composition shown below in Table IV.

TABLE IV

Chemical Composition of Heats of Nickel-Based Alloys, Wt. %

| | Alloy A(1) | | Alloy B(2) | | Alloy C(3) | | Alloy D(4) | |
|---|---|---|---|---|---|---|---|---|
| | Cold-Worked Reduction of Area | | | | | | | |
| Element | 37% | 59% | 37% | 59% | 50% | 60% | 50% | 60% |
| Phosphorus | 0.016 | 0.011 | 0.004 | 0.003 | 0.023 | 0.023 | 0.002 | 0.002 |
| Chromium | 15.47 | 15.06 | 15.9 | 16.0 | 14.7 | 14.7 | 15.52 | 15.52 |
| Molybdenum | 15.15 | 15.66 | 18.3 | 18.5 | 16.4 | 16.4 | 15.48 | 15.48 |
| Iron | 5.63 | 6.37 | 7.70 | 6.81 | 6.15 | 6.15 | 5.54 | 5.54 |
| Cobalt | 2.34 | 2.18 | 1.84 | 1.81 | 1.79 | 1.79 | 2.07 | 2.07 |
| Tungsten | 3.65 | 3.76 | 3.31 | 3.23 | 2.84 | 2.84 | 3.59 | 3.59 |
| Manganese | 0.52 | 0.39 | — | — | 0.31 | 0.31 | 0.60 | 0.60 |
| Vanadium | 0.20 | 0.17 | — | — | 0.43 | 0.43 | 0.17 | 0.17 |
| Carbon | 0.005 | 0.002 | 0.01 | 0.01 | 0.02 | 0.02 | 0.006 | 0.006 |
| Silicon | 0.05 | 0.04 | — | — | 0.06 | 0.06 | 0.09 | 0.09 |

TABLE IV-continued

| Chemical Composition of Heats of Nickel-Based Alloys, Wt. % | | | | | | | | |
|---|---|---|---|---|---|---|---|---|
| | Alloy A(1) | | Alloy B(2) | | Alloy C(3) | | Alloy D(4) | |
| | Cold-Worked Reduction of Area | | | | | | | |
| Element | 37% | 59% | 37% | 59% | 50% | 60% | 50% | 60% |
| Sulfur | 0.005 | 0.002 | 0.001 | 0.001 | 0.004 | 0.004 | 0.004 | 0.004 |
| Nickel | Bal. | Bal. | Bal. | Bal. | Bal. | Bal. | Bal. | Bal. |

(1)Commercial Purity Tubing of Hastelloy C-276, a registered trademark of Cabot Corporation.
(2)Superalloy of present invention in the form of tubing.
(3)Commercial Purity Sheet of Hastelloy C-276, a registered trademark of Cabot Corporation.
(4)Superalloy of the present invention in the form of a sheet.

The four tubular heats shown in Table IV, Alloys A and B which had been cold-worked to a reduction in area of 37% and 59% were each cut into C-rings and aged at various temperatures from 150° C. to 500° C. for times ranging from 10 minutes to 100 hours. The specimens were then stressed and placed in the NACE test solution described below. At periodic intervals they were examined for the onset of cracking. The C-rings were stressed to 100% of the transverse 0.2% offset yield strength by the tightening of a bolt. The yield strength was defined as the stress corresponding to 0.2% offset strength measured in a tensile test. A steel anode was galvanically coupled to the C-ring, causing cathodic polorization and hydrogen charging of the C-ring.

The stressed C-rings were placed in an aqueous $H_2S$ environment which was prepared in accordance with the proposed NACE standard test method (NACE TM-01-77) for evaluating metallic materials for sulfide stress cracking at an ambient temperature as described by J. B. Greer in paper number 97 presented at the NACE Corrosion meeting in Toronto, Canada, Apr. 14–18, 1975. This procedure produced an oxygen-free, $H_2S$ saturated, aqueous solution containing 5% NaCl and 0.5% acetic acid by weight. Oxygen was initially removed from the solution by purging it with nitrogen. Before the specimens were introduced, hydrogen sulfide was then bubbled through the solution for a period of 24 hours. The hydrogen sulfide bubbling was maintained throughout the test. The solution and specimens were maintained at room temperature (22° C.±5° C.) and the tests were conducted at approximately atmospheric pressure.

The specimens were visually examined for cracking by removing them from the bath at regular intervals. Testing was continued until failure of the specimens occurred or until 100 days had elapsed. Visual inspection of the C-ring outer surface was used to determine if cracking had begun. The number of days before fractures were first observed are set forth in Table V.

TABLE V

| The Effect of Aging Severity on the Embrittlement Susceptibility of Tubular Alloys | | | |
|---|---|---|---|
| Alloy Tested | Aging Temp. | Aging Time (hrs) | Time to Failure (days) |
| Alloy A (cold-worked to 37% area reduction) | unaged | — | 100(a) |
| | 149° C. | 339 | 100(a) |
| | 204° C. | 339 | 7 |
| | 371° C. | 20 | <3 |
| | 482° C. | 0.16 | <3 |
| | 482° C. | 100 | <3 |
| Alloy A (Cold-worked to 59% area reduction) | unaged | — | 100 |
| | 149° C. | 258 | 100 |
| | 204° C. | 252 | 4 |
| | 371° C. | 20 | <3 |

TABLE V-continued

| The Effect of Aging Severity on the Embrittlement Susceptibility of Tubular Alloys | | | |
|---|---|---|---|
| Alloy Tested | Aging Temp. | Aging Time (hrs) | Time to Failure (days) |
| | 482° C. | 0.16 | <3 |
| | 482° C. | 100 | <3 |
| Alloy B (cold-worked to 37% area reduction) | unaged | — | 100(a) |
| | 204° C. | 200 | 81 |
| | 371° C. | 20 | 8 |
| | 482° C. | 0.16 | 93 |
| | 482° C. | 200 | 4 |
| Alloy B (cold-worked to 59% area reduction) | unaged | — | 100(a) |
| | 204° C. | 200 | 8 |
| | 371° C. | 20 | 4 |
| | 482° C. | 0.16 | 13 |
| | 482° C. | 200 | <3 |

(a)Specimens were removed from test solution after specified time, no failure.

The results in Table V show that in the case of the alloys of the present invention (Alloy B), and the commercial heats (Alloy A) cracking susceptibility increases with aging severity; as aging time or temperature is increased, the susceptibility increases. On a time-to-failure basis, the low phosphorus material is clearly less susceptible to embrittlement than the commercial purity material (Alloy A). Thus, in the case of cold-worked area reduced superalloys, the alloys of the present invention are superior in terms of hydrogen cracking resistance to the commercial heats having a higher level of phosphorus.

The test specimens were also examined with a scanning electron microscope to evaluate the fracture surface of the fully separated C-rings. The fractures were intergranular, presumably due to the presence of hydrogen. No failures occurred in C-rings which were not galvanically coupled to steel, indicating that hydrogen is necessary for failure. As can be seen from the time-to-failure data in Table V, cracking susceptibility increases with the severity of aging treatment.

Based on the hypothesis that this increase in susceptibility was caused by a redistribution of tramp elements to the grain boundaries, samples of the specimens were scanned by Auger microscopy. The Auger measurements were made on the fracture surfaces of variously heat treated specimens using a Physical Electronics Model 590 Scanning Auger Microprobe (SAM). The specimens were machined into notched beams and charged with hydrogen electrolytically. The electrolyte was 5% (vol.) $H_2SO_4$ with 100 mg/l of sodium arsinite as a hydrogen recombination poison, thus facilitating hydrogen entry. Hydrogen charging was performed at 100 mA/cm$^2$ for at least 48 hours. Samples were subsequently plated with cadmium to prevent hydrogen loss. Charged samples were placed in the ultra high vacuum chamber of the SAM and pumped down to a pressure of $\leqq 1\times10^{-9}$ Torr. They were then fractured in situ and the fracture surfaces were analyzed within 15–30 minutes. The exitation beam voltage was 8 KeV and the current was in the range of 2 to 3 $\mu$A (the beam diameter is typically 0.2 $\mu$m).

Table VI shows the results of the Auger measurements on the intergranular fracture surface of the commercial heat (Hastolloy C-276* alloy, Alloy A) and the alloy of the present invention (Alloy B). As the aging severity increased, the grain boundary concentration of phosphorus increased from 0.73 At%, which was the measured value for the unaged material. Upon aging at 482° C. for 100 hours, as much as 2.8 At% phosphorus was present on the grain boundary surface for an alloy which had a bulk phosphorus concentration of 0.050 At% (0.025 wt. %). The only impurity which was identified on the grain boundary fracture surface was phosphorus. After sputtering to a depth of ~1000 Å on the fracture surface, a level of phosphorus more like that of the bulk was measured. Since the susceptibility of the commercial Hastelloy C-276* alloy to hydrogen embrittlement also increases with the severity of aging, it is reasonable to suspect that phosphorus is playing a role. As shown in the Auger measurements in Table VI, the grain boundary concentrations of phosphorus in the alloys of the present invention (Alloy B) are lower than those in the commercial heats (Hastelloy C-276* alloy) for similar aging conditions. This is expected from the lower bulk concentration of phosphorus. However, some grain boundary segregation does occur in this material. The improved susceptibility of the low phosphorus material to hydrogen embrittlement supports the identification of phosphorus segregation as being responsible for promoting hydrogen embrittlement in cold-worked area reduced superalloys.

*A registered trademark of Cabot Corporation.

TABLE VI

Effect of Aging and Bulk Purity on the Grain Boundary Concentration of Phosphorus in Cold-Worked Alloys

| Material | Aging Temperature | Aging Time (hrs) | Grain Boundary Concentration of Phosphorus (At %) |
|---|---|---|---|
| Alloy | Unaged | — | 0.73 |
| | 371° C. | 20 | 1.3 |
| | 482° C. | 100 | 2.8 |
| | 482° C. | 100 | 0.2[a] |
| Alloy B (Alloy of present inventor) | Unaged | — | 0.31 |
| | 482° C. | 100 | 0.70 |

[a]Sputtered approximately 1000Å.

Table VII, below, shows that the mechanical properties of commercial Hastelloy C-276* alloy and the low phosphorus alloy of the present invention are essentially the same.

*A registered trademark of Cabot Corporation.

TABLE VII

Mechanical Properties of Cold-Worked Alloys

| Material | Cold-Worked Area Reduction | 0.2% Yield Str. MPa | 0.2% Yield Str. (K si) | Tensile Str. MPa | Tensile Str. (K si) | % Elong. |
|---|---|---|---|---|---|---|
| Alloy A | 37% | 1060 | (154) | 1170 | (169) | 22.0 |
| | 59% | 1280 | (186) | 1410 | (204) | 13.0 |
| Alloy B | 35% | 1080 | (156) | 1170 | (170) | 22.0 |
| | 59% | 1270 | (184) | 1370 | (199) | 14.0 |
| Alloy C | 50% | 1180 | (171) | 1350 | (196) | 12.4 |
| | 60% | 1260 | (182) | 1470 | (213) | 12.9 |
| Alloy D | 50% | 1160 | (168) | 1360 | (197) | 12.2 |
| | 60% | 1230 | (178) | 1470 | (213) | 12.1 |

Alloys C and D (Alloy D is the alloy of the present invention containing only 0.002 wt. % phosphorus (0.004 At% phosphorus) as shown in Table IV were also examined for their hydrogen susceptibility in the manner described above. These alloys, however, were obtained as ingots and could not be produced into tubular materials because the quantity available was small. Therefore, the ingots were hot rolled and unidirectionally cold-worked to an area reduction of 50 and 60% into sheets and machined into transverse beam specimens. The mechanical properties, as shown in Table VII above, indicate that the sheets of the cold-worked alloys of the present invention were mechanically similar to the commercial Hastelloy C-276* alloy. The results of steel coupled, stressed beam bend tests conducted in NACE solution (as described above) are shown in Table VIII. It is clearly shown by this data that the low phosphorus cold-worked alloys of the present invention performed better than comparable cold-worked alloys having a higher level of phosphorus.

*A registered trademark of Cabot Corporation.

TABLE VIII

Effect of Aging Severity and Bulk Impurity Level on the Cracking Susceptibility of Cold-Worked Alloys

| Condition | Aging Temperature | Aging Time (hrs) | Time to Failure Alloy C[1] | Time to Failure Alloy D[2] |
|---|---|---|---|---|
| 50% Cold-worked area reduction | Unaged | — | 36[3] | 36[3] |
| | 204 | 200 | 13 | 36[3] |
| | 371 | 20 | <3 | 9 |
| | 482 | .16 | <3 | 36[3] |
| | 482 | 100 | <3 | <3 |
| 60% Cold-worked area reduction | Unaged | — | 36[3] | 36[3] |
| | 204 | 200 | <3 | 36[3] |
| | 371 | 20 | <3 | 36[3] |
| | 482 | .16 | <3 | 36[3] |
| | 482 | 100 | <3 | <3 |

[1]Commercial Hastelloy C-276, a registered trademark of Cabot Corporation.
[2]Alloy of present invention.
[3]Specimens were removed from the test after 36 days, no failure.

The data shown in the Tables show that hydrogen embrittlement susceptibility in the case of cold-worked superalloys increases with aging severity. Auger measurements showed that phosphorus segregation to the grain boundaries also increased with aging severity. These results suggest a relationship between embrittlement and phosphorus concentration on the grain boundaries of the cold-worked alloys. The possible role of phosphorus segregation in hydrogen embrittlement is supported by comparing the data on the low phosphorus cold-worked alloys of the present invention. The cold-worked alloys of the present invention clearly have improved resistance to embrittlement in $H_2S$ environments.

The cold-worked and aged superalloys of the present invention, as can be seen from the above data, possess unique and beneficial combination of properties, i.e., high yield and tensile strengths along with improved resistance to hydrogen embrittlement. The tensile strengths of the cold-worked and aged superalloys of the present invention range from about 150 to 250 ksi (1030 to 1724 MPa), thus rendering them suitable for use as tubular conduits in deep oil or gas wells where pressures of 20,000 psi or more are encountered at temperatures of 200°–275° C. While several new nickel-base and cobalt-base superalloys, such as Hastelloy C-276* alloy, possess these strength levels after cold-working and age strengthening; these alloys readily fail by hydrogen cracking when cathodically charged or when galvanically coupled to carbon steel and exposed to an aqueous salt solution saturated with hydrogen sulfide.

*A registered trademark of Cabot Corporation.

The cold-worked and age stengthened superalloys of the present invention resist hydrogen embrittlement or cracking under test conditions wherein a steel anode is galvanically coupled to a test specimen of said superalloy and said test specimen is exposed to an aqueous test solution saturated with hydrogen sulfide containing 5% NaCl and 0.5% acetic acid, by weight, at room temperature and at atmospheric pressure. The test specimen of the superalloys of the present invention are capable of resisting hydrogen embrittlement or cracking for more than 25 days, and generally more than 100 days when they are stressed in the hydrogen sulfide test solution to 100% of the transverse 0.2% offset yield strength.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention.

What is claimed is:

1. A cold-worked and age strengthened nickel and/or cobalt, chromium, molybdenum superalloy having less than 1 At% phosphorus in its grain boundaries, a tensile strength ranging from 150 to about 250 ksi and a resistance to hydrogen embrittlement such that when a steel anode is galvanically coupled to a test specimen of said superalloy and said test specimen is exposed to an aqueous test solution saturated with hydrogen sulfide containing 5% NaCl and 0.5% acetic acid, by weight, at room temperature and at atmospheric pressure, the test specimen resists hydrogen embrittlement or cracking for more than 25 days when it is stressed to 100% of the transverse 0.2% offset yield strength.

2. The cold-worked and age strengthened superalloy of claim 1 wherein said superalloy contains 12 to 25 wt. % chromium, from 10 to about 20 wt. % molybdenum, up to 10 wt. % iron, up to about 50 wt. % cobalt and the balance essentially nickel.

3. The superalloy of claim 2 wherein the superalloy is further characterized as containing less than 0.003 wt. % phosphorus, less than 0.02 wt. % carbon and less than 0.08 wt. % silicon.

4. The superalloy of claim 1 wherein said superalloy has the following chamical composition in weight percent:

| | |
|---|---|
| Phosphorus | <0.002 |
| Chromium | 14–17 |
| Molybdenum | 14–16 |
| Iron | 0–7 |
| Cobalt | 0–2.5 |
| Aluminum | 0–0.25 |
| Columbium | 0–4 |
| Titanium, Zirconium or Hafnium | 0–0.75 |
| Tungsten | 0–4 |
| Manganese | 0–1 |
| Vanadium or Tantalum | 0–0.4 |
| Carbon | 0–0.01 |
| Silicon | 0–0.03 |
| Nickel and Incidental Impurities | Balance |

5. A cold-worked and age strengthened nickel and/or cobalt, chormium, molybdenum superalloy characterized by having less than 1 At% phosphorus in its grain boundaries, a high tensile strength and an improved resistance to hydrogen embrittlement when subjected to an oxygen-free hydrogen sulfide saturated, aqueous solution containing 5% NaCl and 0.5% acetic acid, by weight, at room temperature and at atmospheric pressure, said superalloy comprising 12 to 25 wt. % chromium, from about 10 to about 20 wt. % molybdenum, up to 10 wt. % iron, up to about 50 wt. % cobalt and the balance essentially nickel, and wherein the phosphorus content in said superalloy is maintained and controlled at a level of less than 0.003 wt. %.

6. A cold-worked and age strengthened superalloy in accordance with claim 5 having the following composition in weight percent:

| | |
|---|---|
| Phosphorus | <0.003 |
| Chromium | 12–15 |
| Molybdenum | 10–20 |
| Iron | 0–10 |
| Cobalt | 0–50 |
| Aluminum | 0–0.5 |
| Columbium | 0–4 |
| Titanium, Zirconium or Hafnium | 0–3 |
| Tungsten | 0–7 |
| Manganese | 0–1 |
| Vanadium or Tantalum | 0–0.75 |
| Carbon | 0–0.02 |
| Silicon | 0–0.08 |
| Nickel and Incidental Impurities | Balance |

7. A cold-worked and age strengthened superalloy in accordance with claim 5 having the following composition in weight percent:

| | |
|---|---|
| Phosphorus | <0.002 |
| Chromium | 14–17 |
| Molybdenum | 14–16 |
| Iron | 0–7 |
| Cobalt | 0–2.5 |
| Aluminum | 0–0.5 |
| Columbium | 0–4 |
| Titanium, Zirconium or Hafnium | 0–0.75 |
| Tungsten | 0–4 |
| Manganese | 0–1 |
| Vanadium or Tantalum | 0–0.4 |
| Carbon | 0–0.01 |
| Silicon | 0–0.03 |
| Nickel and Incidental Impurities | Balance |

8. A cold-worked and age strengthened superalloy in accordance with claim 5 having the following composition in weight percent:

| | |
|---|---|
| Phosphorus | <0.001 |
| Chromium | 14–16 |
| Molybdenum | 15–17 |
| Iron | 4–7 |
| Cobalt | 0–2.5 |
| Aluminum | 0–0.2 |
| Titanium | 0–0.5 |
| Tungsten | 3–4.5 |
| Manganese | 0–1 |
| Vanadium | 0–0.4 |
| Carbon | 0–0.01 |
| Silicon | 0–0.03 |
| Nickel | 52–56 |
| Incidental Impurities | Balance |

9. The superalloy of claim 5 wherein the superalloy has been cold-worked within the range from about 15% to about 90% reduction in area.

10. The superalloy of claim 6 wherein the superalloy has been cold-worked within the range from about 25% to about 75% reduction in area.

11. The superalloy of claim 7 wherein the superalloy has been cold-worked within the range from about 35% to about 65% reduction in area.

12. The superalloy of claim 8 wherein the superalloy has been cold-worked within the range from about 35% to about 65% reduction in area.

13. The superalloy of claim 5 which is further characterized as having been strengthened by aging at a temperature ranging from about 800° F. to about 1200° F.

14. The superalloy of claim 5 in the form of a tubular conduit.

15. A process for producing a superalloy characterized as having a high tensile stength and an improved resistance to hydrogen embrittlement when subjected to an oxygen-free hydrogen sulfide saturated aqueous solution containing 5% NaCl and 0.5% acetic acid, by weight, at room temperature and at atmospheric pressure, which comprises treating an alloy of the following chemical composition in weight percent:

| | |
|---|---|
| Phosphorus | <0.003 |
| Chromium | 12–25 |
| Molybdenum | 10–20 |
| Iron | 0–10 |
| Cobalt | 0–50 |
| Aluminum | 0–0.5 |
| Columbium | 0–4 |
| Titanium, Zirconium or Hafnium | 0–3 |
| Tungsten | 0–7 |
| Manganese | 0–1 |
| Vanadium or Tantalum | 0–0.75 |
| Carbon | 0–0.02 |
| Silicon | 0–0.08 |
| Nickel and Incidental Impurities | Balance |

by the steps:

(a) cold-working said alloy within the range from about 15% to about 90% reduction in area, and (b) age strengthening the cold-worked alloy at a temperature ranging from about 300° F. to about 1100° F.

16. A process for recovering oil and/or gas from subterranean surfaces under conditions of high stress and hydrogen sulfide environments which comprises using a tubular conduit for transporting said oil and/or gas from subterranean surfaces, wherein said tubular conduit comprises a cold-worked and age strengthened nickel and/or cobalt, chromium, molybdenum superalloy having less than 1 At% phosphorus in its grain boundaries, a tensile strength ranging from 150 to about 250 ksi and a resistance to hydrogen embrittlement such that when a steel anode is galvanically coupled to a test C-ring of said superalloy and said C-ring is exposed to an aqueous test solution saturated with hydrogen sulfide containing 5% NaCl and 0.5% acetic acid, by weight, at room temperature and at atmospheric pressure, the test C-ring resists hydrogen embrittlement or cracking for more than 25 days when it is stressed to 100% of the transverse 0.2% offset yield strength.

17. The process of claim 16 wherein said superalloy contains 12 to 25 wt. % chromium, from 10 to about 20 wt. % molybdenum, up to 10 wt. % iron, up to about 50 wt. % cobalt and the balance essentially nickel.

18. The process of claim 17 wherein the superalloy is further characterized as containing less than 0.003 wt. % phosphorus, less than 0.02 wt. % carbon and less than 0.08 wt. % silicon.

19. The process of claim 16 wherein said superalloy has the following chemical composition in weight percent:

| | |
|---|---|
| Phosphorus | <0.002 |
| Chromium | 14–17 |
| Molybdenum | 14–16 |
| Iron | 0–7 |
| Cobalt | 0–2.5 |
| Aluminum | 0–0.5 |
| Columbium | 0–4 |
| Titanium, Zirconium or Hafnium | 0–0.75 |
| Tungsten | 0–4 |
| Manganese | 0–1 |
| Vanadium or Tantalum | 0–0.4 |
| Carbon | 0–0.01 |
| Silicon | 0–0.03 |
| Nickel and Incidental Impurities | Balance |

* * * * *